US005349339A

United States Patent [19]

Kind

[11] Patent Number: 5,349,339

[45] Date of Patent: Sep. 20, 1994

[54] APPARATUS FOR THE DETECTION OF LABELS EMPLOYING SUBTRACTION OF BACKGROUND SIGNALS

[75] Inventor: Burckart Kind, Zurich, Switzerland

[73] Assignee: Actron Entwicklungs Ag, Rotkreuz, Switzerland

[21] Appl. No.: 13,825

[22] Filed: Feb. 3, 1993

[30] Foreign Application Priority Data

Apr. 7, 1992 [CH] Switzerland ..... 1132/92

[51] Int. Cl.[5] ..... G08B 13/187

[52] U.S. Cl. ..... 340/572; 340/551; 340/552

[58] Field of Search ..... 340/572, 551, 552

[56] References Cited

U.S. PATENT DOCUMENTS

| | | | |
|---|---|---|---|
| 4,531,117 | 7/1985 | Nourse et al. | 340/572 |
| 4,663,612 | 5/1987 | Mejia et al. | 340/551 |
| 4,686,517 | 8/1987 | Fockens | 340/572 |
| 5,023,598 | 6/1991 | Zemlock et al. | 340/572 |

FOREIGN PATENT DOCUMENTS

WO91/19278 4/1991 PCT Int'l Appl. .

*Primary Examiner*—Glen Swann

*Attorney, Agent, or Firm*—Finnegan, Henderson, Farabow, Garrett & Dunner

[57] ABSTRACT

An apparatus for the detection of labels used for preventing theft of goods and provided with an electric resonant circuit [(21) and] having a resonant frequency [(fr)] in the MHz range [comprises] has a transmitter [(1)] and a receiver [(2)]. The transmitter [(1)] generates a transmitting signal sequence, whose frequency is wobbled in wobble cycles over and beyond the given resonant frequency of the labels and [radiates] which is radiated by means of a transmitting antenna [(11)]. Signal generation in the transmitter [(1)] takes place digitally and with coinciding phase position with respect to each wobble cycle. In the receiver [(2)] the signals received by means of a receiving antenna [(12)] are scanned and digitized synchronously with signal generation in the transmitter [(1)]. From the digitized signal values of n wobble cycles a background is formed and subtracted from the digitized signal values of the in each case last wobble cycle. A long-term and a short-term background can be formed and the latter is subtracted from the former. By background subtraction it is in particular possible to [discriminate time] eliminate relatively [stationary] time stationary interference, such as is particularly caused by transmitting signal diffractions and reflections on objects present in the vicinity of the transmitting and/or receiving antenna.

8 Claims, 2 Drawing Sheets

Δα
Δα0
t0
t sin α
t0
t

S
t0
t

APPARATUS FOR THE DETECTION OF LABELS EMPLOYING SUBTRACTION OF BACKGROUND SIGNALS

TECHNICAL FIELD

The present invention relates to an apparatus for the detection of labels, which are used for preventing the theft of goods and which have an electric resonant circuit with a resonant frequency ($f_R$) in the MHz range. The apparatus comprises a transmitter and a receiver, the transmitter generating a transmitting signal sequence which is radiated by means of a transmitting antenna, whose frequency is wobbled in wobble cycles over and beyond the given resonant frequency of the labels. Through the evaluation of signals received by a receiving antenna in the receiver, detection takes place of the presence of a label in the area between the transmitting antenna and the receiving antenna.

PRIOR ART

Apparatuses of this type are known in numerous different constructions and are already in use. The problem in all such apparatuses is to discriminate the relatively weak label signals from the constantly present interference background and avoid false alarms. Particular problems are encountered due to interference caused by diffractions and reflections of the high frequency electromagnetic waves radiated by the transmitting antenna on all the objects which may be located in the vicinity, such as walls or articles. Such interference can in fact be very similar to the sought label signals, in which case they cannot be readily eliminated by filtering.

In the case of the apparatus known from US-A-4 531 117 account is taken of his problem by intermittent transmission and reception. Reception and detection only take place in the transmission intervals of the transmitter and following the decay of the transmitting signal, together wish the interference (echo process). Use is made of the fact that the label signals generally decay more slowly than the interference.

DESCRIPTION OF THE INVENTION

The present invention adopts a new way to solve the same problem. In which intermittent transmission and reception are rendered unnecessary. In the case of the inventive apparatus, as characterized in the appended claims, the transmitting signal sequence in the transmitter is generated in digital manner and with coinciding phase position with respect to each wobble cycle. In the receiver the signals received by means of the receiving antenna are, after demodulation, scanned and digitized synchronously with signal generation in the transmitter. From the digitized signal values of n wobble cycles in each case one background is formed, which is subtracted from the digitized signal values of the last wobble cycle or from a foreground. The foreground is formed in the same way as the background, but only using the digitized signal values in each case of the last m wobble cycles. The number n is much higher (preferably by 1 to 2 orders of magnitude) than the number m.

Thus, the invention makes use of a background subtraction for eliminating the critical interference for label discrimination. However, the prerequisite is that the interferences critical for label discrimination are substantially stationary compared with the label signals, i.e. occur always in the same way in a larger number of successive wobble cycles. In connection with the interference caused by the aforementioned diffractions and reflections, this is in practice the case, but only if in each wobble cycle precisely the same signal sequence with a precisely coinciding phase position is radiated via the transmitting antenna. However, the label signals are subject to a time change with respect to their occurrence due to the fact that on passing through the antenna arrangement the labels are necessarily moved.

To be able to fulfill this requirement, the signal sequence radiated by means of the transmitting antenna is generated in digital manner in the transmitter. Thus, in the case of digital signal generation the very critical phase condition can be fulfilled relatively simply and adequately precisely. Therefore scanning in the receiver takes place synchronously with signal generation in the transmitter.

The dependent claims characterize advantageous and preferred developments of the invention.

The invention is described in greater detail hereinafter relative to the attached drawings.

Figure 1:
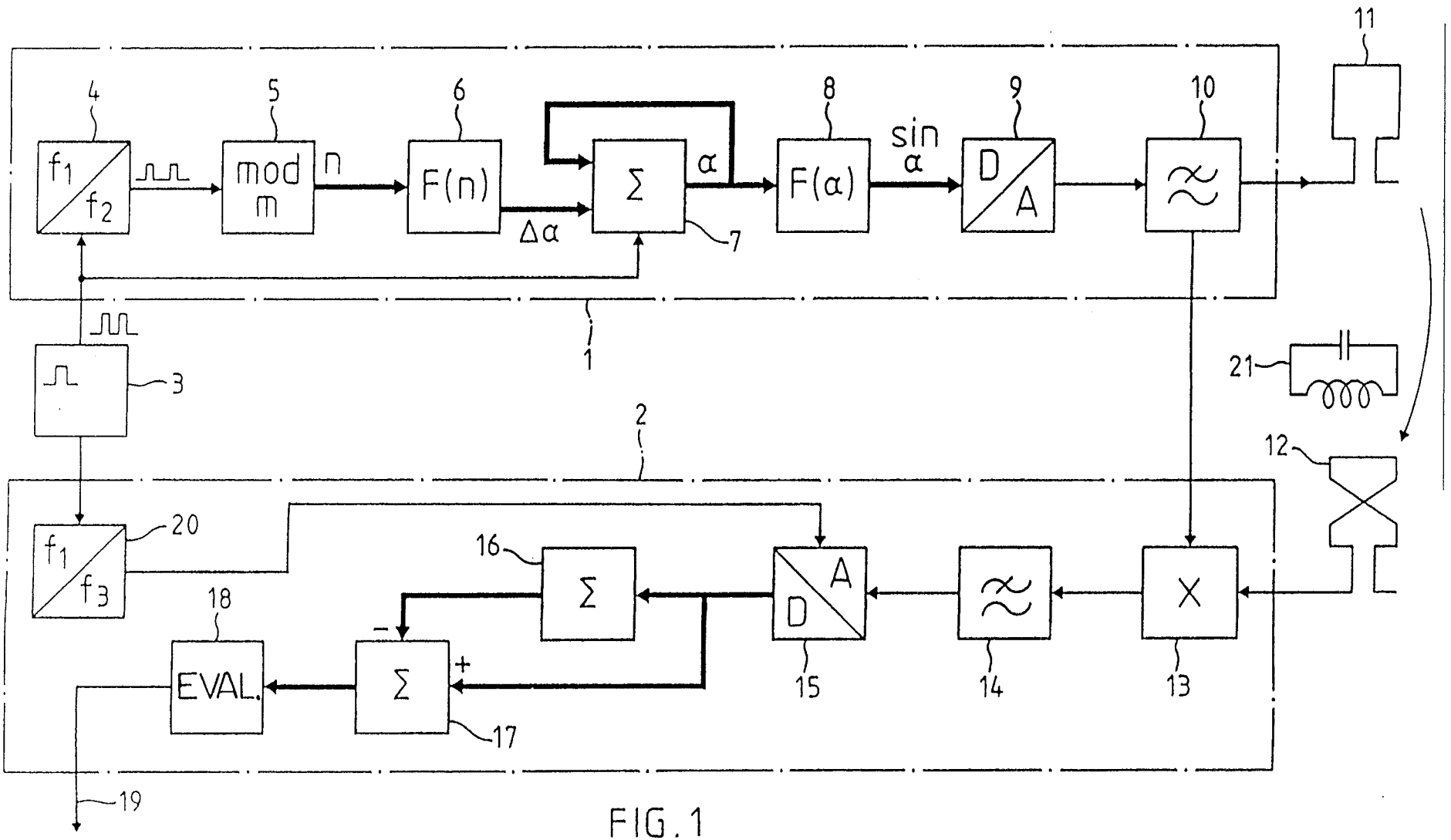
FIG. 1 Diagrammatically shows an apparatus according to the invention.

FIGS. *2a, 2b,* and *2c* are time diagrams for illustrating the function of the apparatus of FIG. 1.

FIG. 1 only shows the apparatus components necessary for the understanding of the inventive idea. To the extent that FIG. 1 relates to multibit data connections (with e.g. 16 bits), they are shown in spread form. To improve drawing resolution FIG. 2 shows the very high frequency processors on a short time scale.

MANNER OF PERFORMING THE INVENTION

The apparatus of FIG. 1 comprises a transmitter 1 and a receiver 2. Both, the transmitter 1 and the receiver 2 are timed or clocked by a common clock generator 3. The clock generator generates a clock signal sequence with a clock frequency of approximately 48 MHz. The latter is consequently a multiple higher than the normally roughly 8.2 MHz resonant frequency of the resonant circuits on the labels to be detected or that of the signal sequence to be generated for this purpose by the transmitter 1.

In a frequency divider 4 the clock signal in the transmitter 1 is divided (e.g. by a factor of 9,) and is then supplied to a modulo-m counter 5. The latter supplies at its data output in the sequence of the divided clock the numbers from O to m as inputs for a series-connected function generator 6. The wobble cycles are determined through the cycle of the modulo-m counter 5 and its frequency is generally chosen between 80 and 85 Hz.

The function generator 6 is preferably a PROM (with a storage capacity of e.g. 1 megabyte), in which is filed a function table. The filed function values correspond to the phase angle increment $\Delta\alpha$ for the signal sequence to be generated digitally in the transmitter 1. FIG. 2 shows under a) the phase angle increment as a function of time t. As a result of its discrete generation the time variation of the phase angle increment is stepped and the function value in each case changes with the rhythm of the divided clock. This is only shown to the left in FIG. *2a*) at the start of the time scale, whereas in the case of longer times the stepped curve is made continuous in order to better show the function course. The latter is sinusoidal about a phase angle increment value $\Delta\alpha$ and not, as is otherwise usual with wobbling, sawtooth-shaped. The advantage of the sinusoidal function course is fewer harmonics.

In an accumulator 7 the phase angle increment values supplied by the function generator 6 are accumulated in the rhythm of the clock signal, i.e. an undivided signal supplied directly by the clock generator is used to form the values for the phase angle $\alpha$ by means of binary addition and from same. The phase angle values $\alpha$ are supplied as inputs to a further function generator 8. As a result of the given bit number of the accumulator 7, its value is automatically upwardly limited. The further function generator supplies for each phase angle value a fixed amplitude value of the signal sequence to be generated. The amplitude values of the signal sequence to be generated once again correspond to sine function values.

Figures 2A, 2B, 2C:
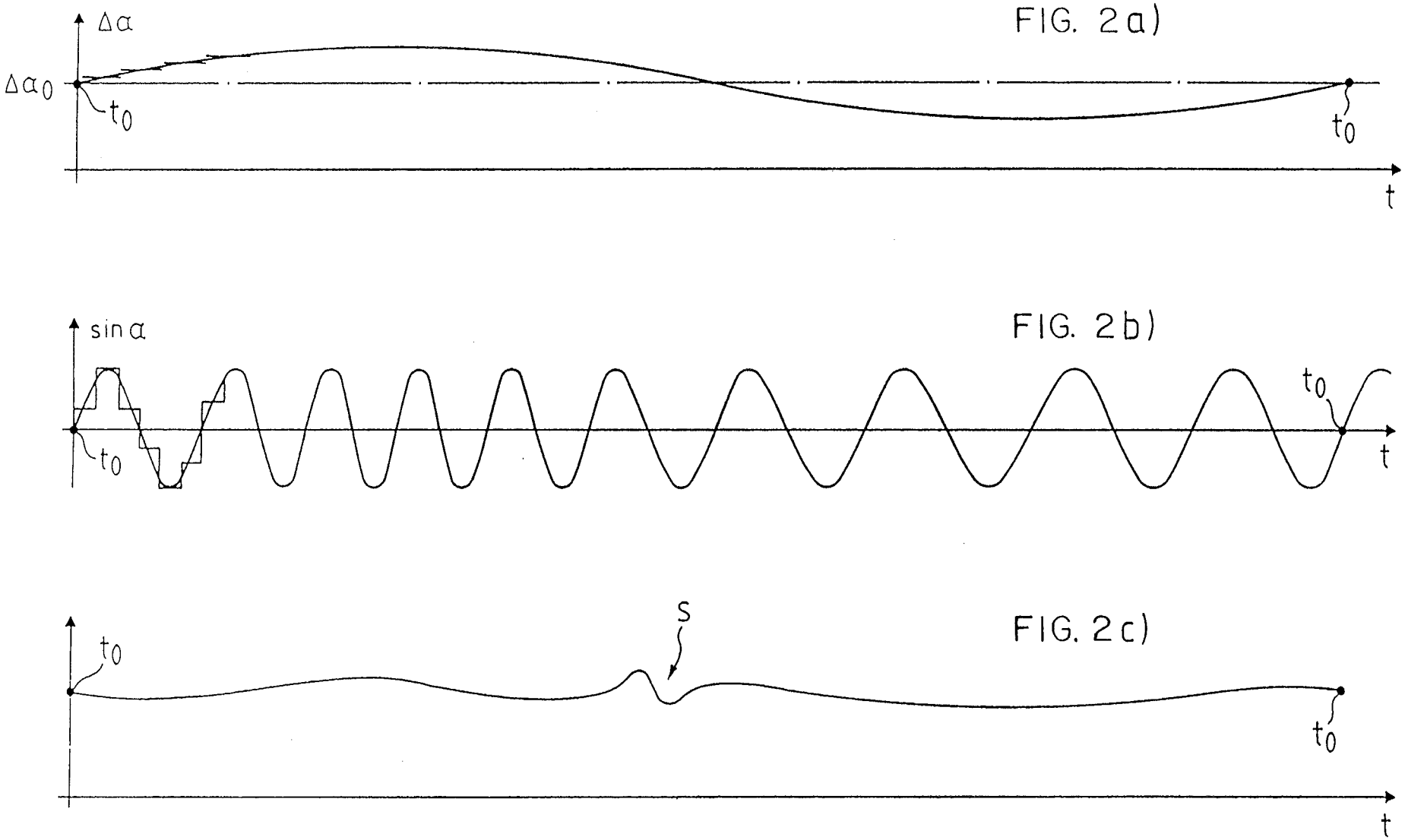

For converting the signal values supplied by the further function generator 8 into an analog voltage signal a digital—analog converter 9 is provided and its output signal is smoothed by means of the low-pass filter 10 before being supplied as a transmitting signal to the transmitting antenna 11. FIG. 2 shows under b), to the left at the start of the time scale, the discrete voltage values supplied by the digital—analog converter 9 and, extended over the entire time scale shown, the transmitting signal curve obtained after filtering by means of the low-pass filter 10. FIG. 2*b* clearly shows how the frequency of this curve increases or decreases over the wobble cycle shown in FIG. 2*a* (normally by $\pm 10\%$).

In the receiver 2 the signal sequence received by means of the receiving antenna is firstly demodulated, in that it is multiplied in the mixer 13 with the interference-free transmitting signal. For this purpose the transmitting signal must not only be transmitted fr the transmitter 1 via the air path, but additionally directly via a line connection to the receiver 2. Demodulation in mixer 13 using the pure, interference-free transmitting signal in place of the otherwise conventional demodulation by multiplication of the interference-containing receiving signal with itself, makes a not inconsiderable contribution to reducing interference.

The result of the demodulation is a "d.c. voltage component", as well as a component with double the transmitting signal frequency. The latter is eliminated in the series-connected low-pass filter 14 (limiting frequency at approximately 7 kHz). The remaining "d.c. voltage component" is shown diagrammatically in FIG. 2*c*). Roughly in the middle of the time scale it has a small "interference" designated S, as is typically caused by a resonant circuit 21 located between the transmitting antenna 11 and the receiving antenna 12, but also as a result of diffractions and reflections of the transmitting signal. For further evaluation and discrimination purposes the "d.c. voltage component" is scanned (e.g. 128×wobble cycle) and digitized. FIG. 1 only shows an analog—digital converter 15 for performing these functions and for the synchronization of the scanning with the wobble cycles determined by the transmitter 1. The converter 15 is supplied with the clock signal of the clock generator 3, which is appropriately divided in the frequency divider 20.

From the digitized signal values of the n (e.g. 800) wobble cycles in each case preceding the last wobble cycle a background is formed in the background former 16 and is subtracted in the difference former 17 from the digitized signal values of the last wobble cycle. However, preferably in each case m (e.g. 16) wobble cycles are combined into a "foreground" and from n' (e.g. 50) such "foregrounds" the background is formed. The background is then subtracted not only from the digitized signal values of the last wobble cycle, but also from the last formed "foreground".

Background formation and subtraction are used for differentiating interference S in the "d.c. voltage component", which in particular are caused by reflections, diffractions and superimposing of the transmitting signal and which are substantially permanently present, from interference S caused by a resonant circuit.

To enable the dropout of the permanently present "interference" during background subtraction, as stated above, there must be maximum coincidence of conditions in each wobble cycle, particularly with respect to the phase of the generated signal sequence. In each wobble cycle the sum over all the phase angle increments must be an integral multiple of $2\pi$. At the times designated $t_0$ in FIG. 2 there must be no phase jump. This very strict "phase condition" can be very simply fulfilled by digital transmitting signal generation. To produce identical conditions in successive wobble cycles there is synchronization of the receiving signal scan using the clock signal also used for the timing of signal generation in the transmitter.

It is obvious that there must be storage means for background formation in the background former 16 that are able to cyclically store the digitized signal values determined by scanning. The signal values belonging to a wobble cycle in each case form a data set. Background formation takes place in that the signal values determined at the same scanning time within the wobble cycles used for background formation are added and subsequently the sum values obtained are divided by the number of wobble cycles used for background formation, i.e. standardization takes place to this number. The formation of said "foreground" fundamentally takes place in the same way. Background subtraction in the difference former 17 takes place separately with respect to the individual scanning times.

The data set resulting from background subtraction is finally supplied to an evaluating unit 18, where it undergoes further evaluation. The evaluating unit can be of a known type and is consequently not described in detail here. By means of, the data set supplied to it, it decides regarding the presence of a resonant circuit in the area between the transmitting antenna 11 and the receiving antenna 12. On a line 19 it generates an alarm signal if the presence of a resonant circuit is detected.

I claim:

1. An apparatus for the detection of labels which are used for preventing the theft of goods and which have an electric resonant circuit with a resonant frequency in the MHz range, comprising:

a transmitter having a transmitting antenna, the transmitter digitally generating a transmitting signal sequence, the transmitting signal sequence having a frequency wobbled in wobble cycles and having a phase position coinciding relative to each wobble cycle, the wobble cycles exceeding the resonant frequency, the transmitting antenna radiating the transmitting signal sequence; and a receiver having a receiving antenna for receiving the transmitting signal sequence, the receiver detecting the presence of a label between the transmitting and receiving antennas by evaluating the transmitting signal sequence, the receiver demodulating the transmitting signal and then scanning and digitizing the demodulated sequence synchronously with the generation of the transmitting signal sequence by the transmitter, the receiver subtracting a background signal from a portion of the digitized signal values, the background signal being formed from n wobble cycles of the digitized signal values.

2. The apparatus according to claim 1, wherein the transmitter and receiver are clocked by a clock generator or by a plurality of clock generators synchronized with one another, the generated clock signal having a clock frequency that exceeds at least a multiple of the resonant frequency of the resonant circuits on the labels.

3. The apparatus according to claim 2, wherein the multiple of the resonant frequency is approximately 5.

4. The apparatus according to claim 2, wherein the amplitude values of the transmitting signal sequence are discretely digitally generated in the same way in each wobble cycle in the transmitter and are subsequently converted into voltage values by a digital—analog conversion.

5. The apparatus according to claim 1, wherein the amplitude values of the transmitting signal sequence are discretely digitally generated in the same way in each wobble cycle in the transmitter and are subsequently converted into voltage values by a digital—analog conversion.

6. The apparatus according to one of claims 1, 2, or 5, wherein the demodulation in the receiver of the signals received by the receiving antenna takes place by multiplication of said received signals with the transmitting signal sequence supplied to the transmitting antenna and obtained directly from the transmitter.

7. The apparatus according to claim 1, wherein the portion of the digitized signal values is the last wobble cycle.

8. The apparatus according to claim 1, wherein the portion of the digitized signal values is a foreground, the foreground being formed from the last m wobble cycles, wherein n exceeds m.

* * * * *

UNITED STATES PATENT AND TRADEMARK OFFICE

CERTIFICATE OF CORRECTION

PATENT NO. : 5,349,339

DATED : September 20, 1994

INVENTOR(S) : Burckart KIND

It is certified that error appears in the above-indentified patent and that said Letters Patent is hereby corrected as shown below:

In the abstract, line 3, delete "[(21) and]";

line 4, delete "[(fr)]"; and "[comprises]";

line 5, delete "[(1)]" (both occurrences ) and "[(2)]";

line 8, delete "[(radiates)]";

line 9, delete "[(11)]";

line 10, delete "[(1)]";

line 12, delete "[(2)]";

line 13, delete "[(12)]";

line 15, delete "[(1)]";

UNITED STATES PATENT AND TRADEMARK OFFICE

CERTIFICATE OF CORRECTION

PATENT NO. : 5,349,339

DATED : September 20, 1994

INVENTOR(S) : Burckart KIND

It is certified that error appears in the above-indentified patent and that said Letters Patent is hereby corrected as shown below:

line 21, delete "[(discriminate time)]";

line 22, delete "[(stationary)]";

Signed and Sealed this

Fifteenth Day of November, 1994

*Attest:*

Bruce Lehman

BRUCE LEHMAN

*Attesting Officer*

*Commissioner of Patents and Trademarks*